US005228311A

United States Patent [19]

Erdmann et al.

[11] Patent Number: 5,228,311

[45] Date of Patent: Jul. 20, 1993

[54] COOLING APPARATUS

[75] Inventors: Klaus Erdmann, Mergelstetten; Helmut Konopa, Leipheim; Bringfried Peglow, Herbrechtingen, all of Fed. Rep. of Germany

[73] Assignees: The Coca-Cola Company, Atlanta, Ga.; Bosch-Siemens Hausgerate GmbH, Munich, Fed. Rep. of Germany

[21] Appl. No.: 745,391

[22] Filed: Aug. 15, 1991

[30] Foreign Application Priority Data

Aug. 16, 1990 [DE] Fed. Rep. of Germany ..... 4025984

[51] Int. Cl.[5] ..... F25D 19/00

[52] U.S. Cl. ..... 62/389; 62/452; 62/453; 62/454; 62/456

[58] Field of Search ..... 62/389, 428, 452, 454, 62/456, 507, 453

[56] References Cited

U.S. PATENT DOCUMENTS

| | | | |
|---|---|---|---|
| 2,637,178 | 5/1953 | Galazzi et al. | 62/456 X |
| 2,666,302 | 1/1954 | Philipp | 62/454 X |
| 2,667,762 | 2/1954 | Hornaday | 62/456 |
| 2,705,877 | 4/1955 | King | 62/456 X |
| 2,753,697 | 7/1956 | Baillif | 62/454 X |
| 2,880,597 | 4/1959 | Wellborn | 62/454 X |
| 3,363,432 | 1/1968 | Sholtes | 62/389 X |
| 3,379,241 | 4/1968 | Gau | 62/456 X |
| 3,468,370 | 9/1969 | Castillo | 62/389 X |
| 3,570,266 | 3/1971 | Alvarez et al. | 62/389 X |
| 3,827,483 | 8/1974 | Hopkinson | 62/507 X |
| 3,990,262 | 11/1976 | Griffin . | |
| 4,866,945 | 9/1989 | Bender et al. | 62/389 X |

FOREIGN PATENT DOCUMENTS

| | | | |
|---|---|---|---|
| 636683 | 10/1936 | Fed. Rep. of Germany | 62/456 |
| 1820343 | 10/1960 | Fed. Rep. of Germany . | |
| 1120480 | 12/1961 | Fed. Rep. of Germany | 62/452 |
| 1989854 | 3/1968 | Fed. Rep. of Germany . | |
| 69413952 | 10/1969 | Fed. Rep. of Germany . | |
| 2138527 | 2/1973 | Fed. Rep. of Germany | 62/452 |
| 7838836 | 4/1979 | Fed. Rep. of Germany . | |
| 1557409 | 2/1969 | France | 62/456 |
| 2610706 | 10/1988 | France . | |
| 4477 | 2/1969 | Japan | 62/389 |
| 857396 | 12/1960 | United Kingdom | 62/454 |

*Primary Examiner*—Henry A. Bennet
*Assistant Examiner*—C. Kilmer
*Attorney, Agent, or Firm*—Birch, Stewart, Kolasch & Birch

[57] ABSTRACT

For enhanced cooling power in a beverage vending machine the compressor is arranged in a recess of the apparatus housing, and the condenser in the form of a coil-shaped tube, is arranged in a convection shaft connected to the recess. One wall of the shaft is formed by the rear wall of the housing. Inside the shaft the tube coil of the condenser is disposed diagonally upwards in the direction of the rear wall of the apparatus housing.

6 Claims, 3 Drawing Sheets

COOLING APPARATUS

BACKGROUND OF THE INVENTION

The present invention relates to a cooling apparatus with a compressor and a condenser arranged in a cooling circuit, where the compressor is arranged in a recess in the interior of the housing of the apparatus and the condenser in a convection shaft open to the recess, the shaft having air inlets in its lower area and air outlets in its upper area, where a shaft wall forms the rear wall of the housing of the apparatus. The condenser consists of a serpentine-shaped tube assembled in one plane. Cooling air enters the shaft through the air inlets, cools the condenser and emerges through the air outlets. Air also enters the recess through a lower opening, cools the compressor, flows through the shaft and leaves it through the air outlets.

The apparatus of the present invention is particularly well suited for use in post-mix beverage-vending machines, in which carbonated water is blended with beverage concentrates, for cooling the final ingredients of the beverage to a suitable temperature for dispensing a cooled drink from the machine. The apparatus is equally suited for beverage-vending vending machines in which bottles or cans of a pre-mix drink are stored at an adjustable temperature lower than ambient temperature.

A housing for a domestic beverage-vending machine with a cooling apparatus including evaporator and condenser is already known from German Registered Design 78 38 836. There the cooling apparatus and condenser are arranged in a common space within the housing. The condenser, which consists of a cooling coil assembled in a single plane, stands vertically inside the housing of the vending machine and is surrounded by vertical walls that form a convection shaft. Air from around the vending machine passes through air inlets in the floor of the common space to the condenser, there picks up heat and emerges from the housing through air outlets. The shaft-shaped arrangement of the space in the condenser area thus forms a chimney for the stream of cooling air. The intended chimney effect, however, is limited and does not meet increased demands on the cooling system.

SUMMARY OF THE INVENTION

In view of these facts it is a primary object of the present invention to create a cooling apparatus for a beverage vending machine with improved cooling power.

An apparatus that fulfills this task according to the invention is specially characterized in that the condenser is arranged within the shaft so that it extends diagonally upwards in the direction of the rear wall of the apparatus housing.

The apparatus of the present invention displays a number of advantages. The improvement in cooling power is simply achieved through good flow, mechanical and thermodynamic location and relative arrangement of the condenser and compressor. Even for the achievement of relatively high levels of cooling power, this eliminates the use of a fan which would strengthen the stream of cooling air and thereby enhance cooling power but on the other hand would produce undesirable heat. The solution according to the invention, therefore, also conserves energy.

In a further advantageous construction according to the invention, the tube forming the condenser has a serpentine configuration which consists of straight, vertical and mutually parallel tubular sections, joined at their lower and upper ends by semicircular tubular sections, with the straight sections joined by straight, horizontal and mutually parallel cooling vanes for heat conduction. The cooling vanes increase the surface area of the condenser tube and thereby improve the cooling power of the apparatus. The special arrangement of condenser tube and cooling vanes causes a marked turbulence in the stream of cooling air and thereby still further improves the cooling power of the apparatus.

These effects are yet further increased if the straight tubular sections have cooling vanes on their upper as well as their lower sides.

In a further advantageous construction according to the invention, the serpentine tube that forms the condenser has in its upper region buffer strips made from a vibration-deadening material pressing against the rear wall of the shaft.

This form of the apparatus according to the invention is characterized by the fact that noises created by vibration of the condenser track are considerably deadened. Fatigue-induced cracking of the tube owing to compressor vibration where the condenser tube is rigidly mounted is avoided. Thus the mechanical stability of the combination of compressor and condenser track is enhanced.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention and wherein.

DETAILED DESCRIPTION OF PREFERRED EMBODIMENTS

Figure 1:
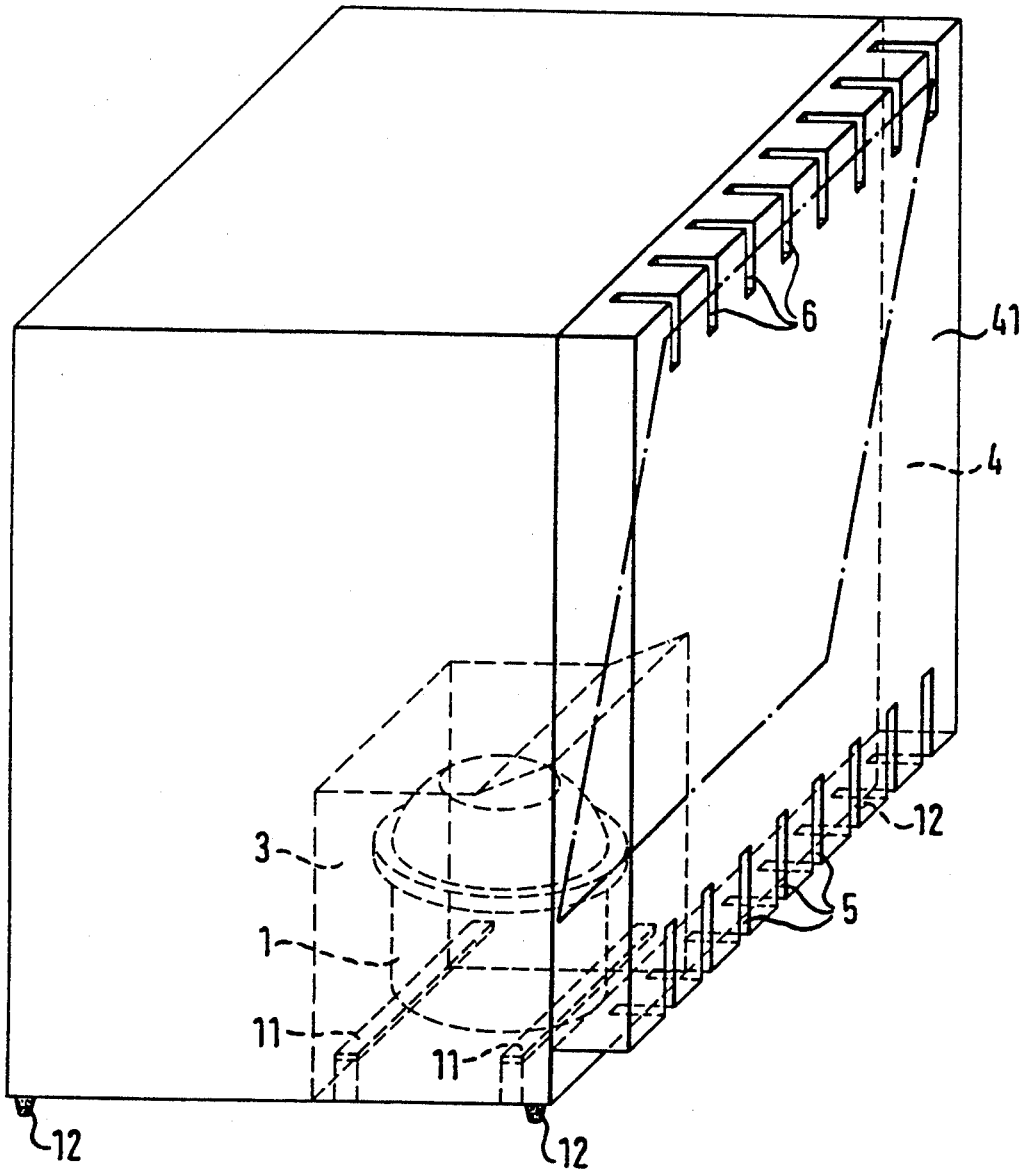
FIG. 1 is a side and rear perspective view showing the location of the cooling apparatus of the present invention with respect to a beverage vending machine housing.

The housing of the cooling apparatus according to the invention, shown in perspective in FIG. 1, advantageously consists of flat metal sheets set at right angles to each other. The housing has an opening on its underside giving access to a recess 3 for a compressor 1. The compressor 1 is mounted on horizontal bearings which advantageously consist of narrow metal bars that provide the necessary stability of support for the compressor inside the housing. Their narrow shape also permits unhampered access for the cooling air entering through the lower opening of the recess to almost the entire underside of the compressor.

On the rear of the housing a metal sheet is attached that forms the rear wall 41 of the housing and has air slits 5, 6 in its lower and upper regions. Cooling air enters the housing through the lower air slits 5. The cooling air reaches the condenser, whose location diagonally to the rear wall 41 is shown schematically in FIG. 1 by the dashed and dotted line. Having been heated by the condenser, the cooling air emerges from the housing through the upper air slits 6. As can now be seen from FIG. 2, the stream of air flowing through the recess opening and shaft 4 is relatively strongly heated by the compressor 1 and transports the stream of air flowing through the lower air slits 5, shaft 4 and upper air slits 6, this stream being heated by the condenser, and thus positively affects the cooling power of the apparatus.

The metal sheet on the rear of the housing thus forms a convection shaft 4 for the cooling air. The shaft 4 is open to the recess 3 and together with it forms a common space. In the embodiment shown in FIG. 1 the recess, open to the underside, is tapered on its upper side towards the shaft 4; this taper guides the air stream from the recess 3 into the shaft 4. The cooling air entering through the lower opening of the recess flows over the compressor 1, is heated and passes through the recess 3 into the shaft 4. It then climbs in a practically vertical upwards direction and emerges from the housing through the upper air slits 6.

The housing of the apparatus advantageously stands on the corner feet 12 whose height is such that a sufficient quantity of cooling air can reach the opening in the compressor recess.

Figure 2:
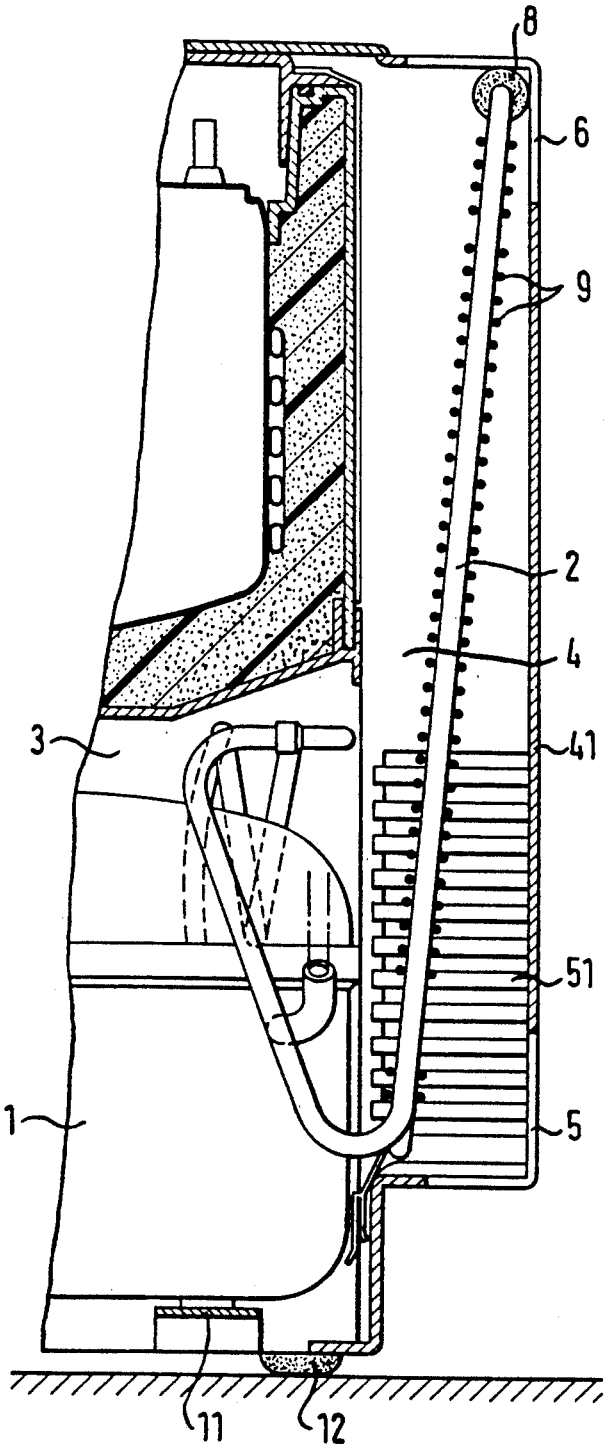
FIG. 2 is a partial sectional view of the housing of FIG. 1 illustrating the compressor, condenser and ventilation shaft of the cooling apparatus of the present invention.

FIG. 2 clearly shows the arrangement of the compressor 1 and condenser 2.

The compressor 1 and condenser 2 are arranged in a cooling circuit, not shown in greater detail in the drawing, that conventionally further includes a relief valve and an evaporator arranged in a cooling space.

The compressor 1 and condenser 2 are located in a common space inside the housing of the apparatus. This space is formed by the recess 3 and the adjoining shaft 4.

Figure 3:
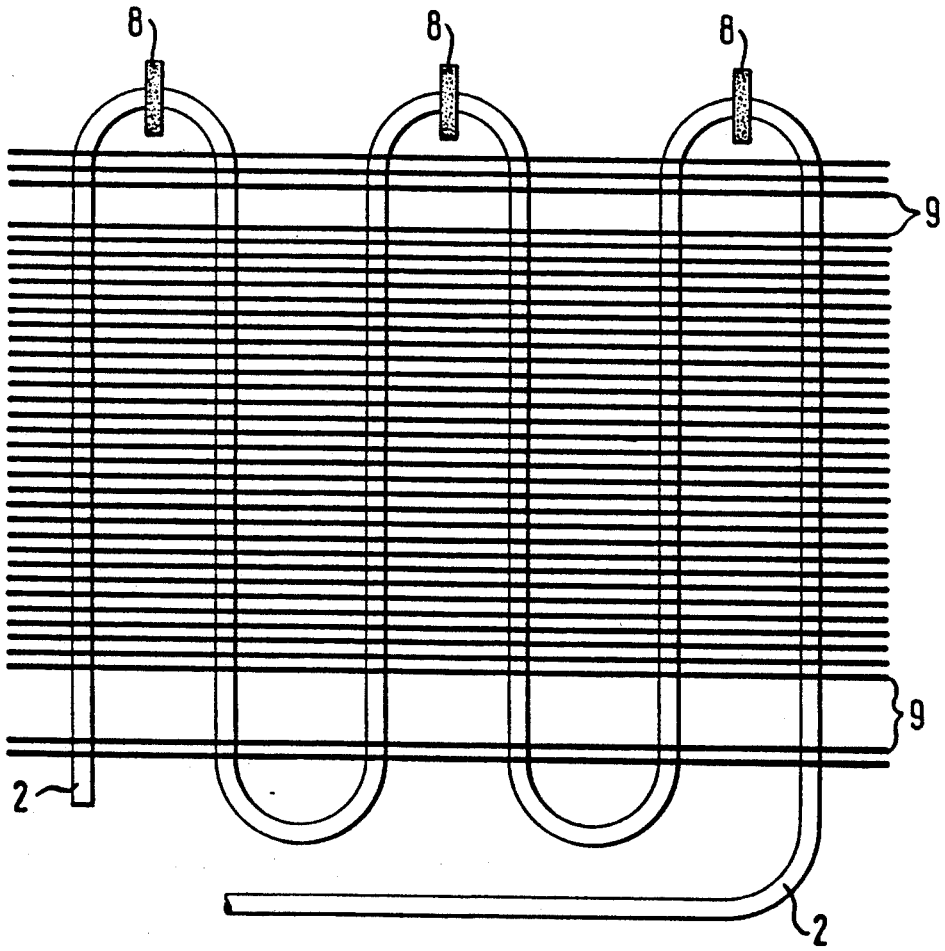
FIG. 3 is a plan view of the serpentine condenser of the present invention.

The condenser 2 can, in particular, consist of a serpentine or coil-shaped tube, an example of whose shape is shown in FIG. 3. The serpentine tube forming the condenser 2 is assembled in one plane.

This plane is disposed, according to the invention, diagonally within the shaft 4, in particular diagonally upwards towards the rear wall 41 of the apparatus housing. In this arrangement the air heated by the compressor 1 and emerging from the recess 3 does not reach or scarcely reaches the condenser tube arranged diagonally in the shaft 4; it tends much more to follow the direct path to the upper air slits 6 through which it emerges from the housing.

Depending on the dimensions of the shaft 4, which, as described, functions as a chimney, the diagonally arranged plane of the tube coil can be set at varying angles to a horizontal plane through the foot of the condenser track 2, particularly angles from 70° to 85°.

The rear wall 41 of the housing, which forms one wall of the shaft 4, possesses, in addition to the upper air slits 6 through which the heated air emerges, further air slits 5 through which cooling air from outside enters the shaft 4. Further air slits ca be provided in the side walls of the shaft, particularly access slots 51 in the vicinity of the motor-driven compressor 1, which undergoes relatively strong heating and thus requires corresponding cooling.

The compressor 1, mounted on the horizontal bearings 11, receives fresh air through the wide lower opening of the recess 3, as already described in FIG. 1. The feet 12 at the corners of the apparatus housing are sufficiently high for the necessary cooling air to reach the opening of the recess 3.

As shown in FIGS. 2 and 3, cooling vanes 9 of the heat-conductive material can be affixed to the condenser tube 2, which increase the surface area of the condenser tube and thus accelerate the cooling process. The cooling vanes 9 are mounted particularly on the upper and lower sides of the condenser tube.

Buffer strips 8 in the upper area of the condenser tube press advantageously against the rear wall 41 of the shaft 4 and simultaneously against the horizontal roof or top wall of the shaft. This provides an elastic support for the tube. The buffer strips 8 are constructed particularly as so-called separation rolls that concentrically surround the tube and consist of vibration-deadening material. This construction and arrangement in the shaft 4 ensures a mechanically stable, elastic support for the condenser tube. Vibrations from the compressor 1 carrying over to the tube are deadened, thus avoiding fatigue-cracking of the tube as a consequence of rigid mounting. The buffer strips 8 also help to deaden noise.

As already described, the shaft 4 has air inlets 5, and if necessary also slots 51, in its lower region and air outlets 6 in its upper region. Cooling air enters through inlets 5, 51 into the shaft 4 and reaches the condenser 2 whose thermal energy is transferred to the cooling air. The heated air expands, becoming less dense, and is dislodged by cooler air with higher density. The shaft 4 thus functions as a convection shaft or chimney. The heated air emerges from it through the outlets 6.

The illustrated diagonal arrangement of the condenser tube 2 ensures that air already heated by the condenser no longer contacts the condenser on its further journey through the shaft 4 but travels directly to the outlets 6 in the upper region of the shaft 4. In contrast to this, in the case of a vertical arrangement of the condenser tube, the ascending cooling air, already heated in the lower regions of the tube, would also pass over the center and upper regions of the coil and could therefore cool these to only a slight degree.

In this arrangement the shaft 4 receives both air emerging from the recess 3 after having been relatively strongly heated by the compressor 1 and also air for cooling the condenser 2. The air that has been relatively strongly heated by the compressor 1 creates low pressure in the shaft 4 below the condenser 2 and thereby acts as a vacuum source for the stream of air entering through the inlets 5, 51 for cooling the condenser 2. The flow of air for cooling the condenser 2 is thereby strengthened and the cooling power of the apparatus enhanced.

FIG. 3 shows a possible construction of the condenser tube 2. This consist of straight, vertical and mutually parallel tubular sections joined at their lower and upper ends by semicircular tubular sections to create an overall serpentine or coil shape.

Heat-conducting cooling vanes 9 are fitted to the condenser tube 2, advantageously horizontally, that is vertical with respect to the straight, vertical tubular sections. The cooling vanes 9 offer a dual contribution to enhancing the cooling power. On the one hand they increase the effective surface area or the condenser tube; on the other hand the horizontal arrangement of the cooling vanes 9 creates turbulence in the cooling air rising through the shaft. The tube 2 also possess vibration-deadening buffer strips 8 in its upper region which press on the upper interior edge of the shaft on the rear wall of the housing.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. Apparatus for dispensing beverages, comprising: a cooling circuit including a compressor and a condenser, the compressor being located in a recess inside a housing of the apparatus and the condenser being located in a convection shaft that is open to the recess and has air inlets in its lower regions and air outlets in its upper regions, wherein one wall of the shaft is formed by the rear wall of the apparatus housing, said air inlets comprise a plurality of right angled slots formed in the rear wall and an adjoining bottom wall of the shaft, and said air outlets comprise a plurality of right angled slots formed in the rear wall and an adjoining top wall of the shaft, and wherein the condenser includes a coil-shaped tube arranged in one plane and wherein cooling air both enters through the air inlets into the shaft, cooling the condenser and emerges from the shaft through the air outlets and also enters through the lower opening in the recess, cools the compressor, flows through the shaft and emerges from the shaft through the air outlets, said coil-shaped tube being comprised of straight, vertical and mutually parallel tubular sections which are joined at their lower and upper ends by semicircular tubular sections, the straight tubular sections being joined by straight, horizontal and mutually parallel cooling vanes for heat conduction, and further comprising means for disposing the condenser inside the shaft so that it extends diagonally upwards in the direction of the rear wall of the housing away from the location of the recess and the compressor located therein; and wherein the condenser has buffer strips of vibration-deadening material in its upper regions pressing simultaneously against the rear wall and top wall of said shaft.

2. The apparatus as in claim 1, wherein the straight tubular sections have cooling vanes on upper and lower sides thereof.

3. The apparatus as in claim 1, wherein the diagonal orientation of the condenser is set at an angle in the range of from 70° to 85° from a horizontal plane through the bottom of the coil-shaped tube.

4. The apparatus as in claim 1, wherein said recess has an upwardly extending angular roof portion for directing air from the recess up the shaft on an opposite side thereof from the rear wall.

5. The apparatus as in claim 1 and further comprising a plurality of parallel air inlet slots formed in at least one adjoining side wall of the shaft and in a lower region thereof adjacent said compressor.

6. The apparatus as in claim 1 and further comprising a plurality of parallel air inlet slots formed in both adjoining side walls of the shaft adjacent the location of said compressor.

* * * * *